US009255409B2

(12) United States Patent
Moore et al.

(10) Patent No.: US 9,255,409 B2
(45) Date of Patent: Feb. 9, 2016

(54) POLE BASE BOLT TEMPLATE

(71) Applicant: Construction Innovations LLC, Sacramento, CA (US)

(72) Inventors: David Moore, Folsom, CA (US); William Hubbard, Loomis, CA (US); Brent Iseman, Pleasanton, CA (US)

(73) Assignee: Construction Innovations LLC, Sacramento, CA (US)

( * ) Notice: Subject to any disclaimer, the term of this patent is extended or adjusted under 35 U.S.C. 154(b) by 493 days.

(21) Appl. No.: 13/741,044

(22) Filed: Jan. 14, 2013

(65) Prior Publication Data

US 2013/0207305 A1 Aug. 15, 2013

Related U.S. Application Data

(60) Provisional application No. 61/598,722, filed on Feb. 14, 2012.

(51) Int. Cl.
*E04C 5/16* (2006.01)
*E04H 12/22* (2006.01)

(52) U.S. Cl.
CPC ..... *E04C 5/168* (2013.01); *E04H 12/22* (2013.01)

(58) Field of Classification Search
CPC . E04H 12/22; E04H 12/2253; E04H 12/2276; E04C 5/168; E04C 5/18; E04C 5/162; E04C 5/166
USPC ..... 249/51, 91, 210, 469; 33/562, 566
See application file for complete search history.

(56) References Cited

U.S. PATENT DOCUMENTS

| | | | | | |
|---|---|---|---|---|---|
| 681,551 | A * | 8/1901 | Hulse et al. | 33/525 |
| 992,312 | A * | 5/1911 | Westlake | 249/51 |
| 2,760,272 | A * | 8/1956 | Van Cantie | 33/518 |
| 3,219,308 | A * | 11/1965 | Halstead | 249/205 |
| 3,458,184 | A * | 7/1969 | Schlosser | 269/287 |
| 3,963,210 | A | 6/1976 | Macklin | |
| 4,000,591 | A * | 1/1977 | Courtois | 52/689 |
| D246,512 | S | 11/1977 | McFarland et al. | |
| 4,736,554 | A * | 4/1988 | Tyler | 52/105 |
| 4,749,165 | A * | 6/1988 | Moraca | 249/48 |
| 5,056,966 | A * | 10/1991 | Lee | 408/115 R |
| 5,499,885 | A * | 3/1996 | Chapman | 403/380 |
| 5,630,303 | A * | 5/1997 | Devenish, III | 52/295 |
| 5,800,727 | A * | 9/1998 | Croghan | 249/51 |
| 5,836,132 | A | 11/1998 | Weathersby | |
| 6,077,000 | A * | 6/2000 | Gibbons et al. | 408/72 B |
| 6,431,517 | B1 * | 8/2002 | Chapman | 249/93 |
| 6,543,742 | B2 * | 4/2003 | Wells | 249/51 |
| 6,643,945 | B1 | 11/2003 | Starks | |
| 6,840,491 | B2 * | 1/2005 | Swinimer | 249/51 |
| 6,857,808 | B1 * | 2/2005 | Sugimoto et al. | 403/41 |

(Continued)

*Primary Examiner* — Yogendra Gupta
*Assistant Examiner* — Emmanuel S Luk
(74) *Attorney, Agent, or Firm* — Temmerman Law Office; Mathew J. Temmerman

(57) ABSTRACT

A pole base bolt template that provides easy and accurate means to hold pole anchor bolts and a rebar cage in a pole base form while pouring concrete or other filling material into the form. The pole base bolt template comprises a plurality of arms disposed around a central hub, each arm comprising a slotted bolt hole, bolt diameter markings, and a form hook adaptable to secure the template to a form, and each arm being shaped so as to raise the entire template above the top of the form. The template further comprises a plurality of gaps between the arms that allow easy access to the form and the filling material.

16 Claims, 11 Drawing Sheets

(56) References Cited

U.S. PATENT DOCUMENTS

| | | | | |
|---|---|---|---|---|
| 7,155,875 | B2 * | 1/2007 | Henderson | 52/741.15 |
| 7,984,541 | B1 | 7/2011 | Davidson | |
| 8,136,260 | B1 * | 3/2012 | Jones | 33/518 |
| 8,317,226 | B1 * | 11/2012 | Wong | 280/769 |
| D702,569 | S * | 4/2014 | Moore | D10/64 |
| 9,091,037 | B2 * | 7/2015 | Fairbairn | |
| 2002/0112437 | A1 * | 8/2002 | Queen | 52/677 |
| 2004/0040224 | A1 * | 3/2004 | Dayton | 52/93.1 |
| 2006/0016140 | A1 * | 1/2006 | Smith | 52/295 |
| 2006/0022189 | A1 * | 2/2006 | Collins, IV | 256/65.14 |
| 2010/0229415 | A1 * | 9/2010 | Knudsen | 33/613 |
| 2012/0324825 | A1 * | 12/2012 | Vrame | 52/745.21 |
| 2013/0019559 | A1 * | 1/2013 | Espinosa | 52/698 |
| 2015/0113893 | A1 * | 4/2015 | Patterson et al. | 52/297 |
| 2015/0189988 | A1 * | 7/2015 | Saich et al. | |
| 2015/0191929 | A1 * | 7/2015 | Takahashi et al. | |

* cited by examiner

POLE BASE BOLT TEMPLATE

RELATED APPLICATIONS

This application claims priority from the U.S. provisional application with Ser. No. 61/598,722, which was filed on Feb. 14, 2012. The disclosure of that provisional application is incorporated herein as if set out in full.

BACKGROUND OF THE DISCLOSURE

1. Technical Field of the Disclosure

The present invention relates in general to templates for installing pole bases. More specifically, the present disclosure relates to a pole base bolt template for providing an easy and accurate means to hold pole anchor bolts and a rebar cage in a pole base form while pouring concrete or other filling material into the form for the future installation of a pole.

2. Description of the Related Art

Pole base bolt templates allow contractors to easily install pole anchor bolts and rebar cages in pole bases. Pole bases, which are used to support among other items, street lights, parking lot lights, street signs, parking lot signs, traffic signals, flag poles, lighting fixtures, and other column-like structures generally comprising a concrete base including anchor bolts, rebar cages, and conduit stubs, and generally support any column made of concrete, metal, wood, or other suitable materials. Pole base bolt templates allow pole anchor bolts and rebar cages to be set accurately in the concrete base form at the correct bolt circle alignment, angle, projection (height) and in a level arrangement. Ideally, pole base bolt templates come in a variety of sizes to accommodate different form sizes, and include means to allow for bolt placement to meet various bolt patterns as well as different bolt sizes for use in various situations.

Conventional templates for supporting anchor bolts and rebar cages in pole base installations suffer from considerable drawbacks. For example, these templates often require additional materials to support the template, require extensive modification for each application, or are custom-made for each installation and generally not reusable. These limitations frequently make such conventional templates expensive, both in terms of material cost and labor cost. Such conventional templates are typically cumbersome to use, often requiring additional manpower to pour and finish the base. Additionally, such conventional templates frequently yield inconsistent results. Pole bases constructed using these crude templates frequently suffer misalignment of the anchor bolts, un-centered rebar cages, leaning bases, unfinished tops of bases, bottom leveling nuts buried in the concrete base, inaccurate bolt projections, and the necessity of re-working the pole base, thereby increasing the labor and material costs. Also, conventional templates must be removed during the concrete finishing process in order to provide access for the installers to smoothly finish the concrete on top of the pole base and remove the bottom-leveling nut from the concrete for future use. This premature removal of the template can compromise the structural integrity of the base as well as disturb the alignment of the anchor bolts and rebar cage. That is to say, the conventional template itself often impedes the ability of workers to reach the top of the pole base in order to smooth the pole base concrete, as well as to save the bottom nuts for reuse. Two commonly used conventional templates are: 1) a simple assembly of 2×4 dimensional lumber and fastening devices; and 2) a square template made of plywood. Both of these conventional templates require the drilling of holes for anchor bolts and are sometimes removed after the concrete has hardened. This leaves indentations and other marks on the hardened concrete pole base, which later require chipping, patching or sacking of the base. Many times these conventional templates are removed while the concrete is still wet, potentially disturbing the bolts and rebar cage, and thus potentially compromising the structural integrity of the pole base.

Therefore, there is a need for a pole base bolt template that will provide a cost effective and improved means for anchor bolt and rebar cage installation. Such a template would provide an efficient and accurate means of anchor bolt and rebar cage installation, and would not require any additional material to support the template itself and would be reusable. Such a template would be raised from the top of the concrete form to keep the bottom leveling nuts and washers out of the concrete. Such a template would also provide easy access for the installer to create a smooth concrete finish on the top of the pole base at the time the concrete is poured into the form instead of attempting to remove the template and finish the top surface while the concrete is only partially set, or patching or chipping the top surface later.

SUMMARY OF THE DISCLOSURE

To minimize the limitations found in the prior art, and minimize other limitations that will be apparent upon the reading of the specifications, the preferred embodiment of the present invention provides a pole base bolt template for installing pole anchor bolts (or other anchor bolts) and rebar cages in a concrete pole base. Preferably the pole is a light pole and preferably the base is a concrete light pole base, although additional types of poles may be installed on additional types of bases without departing from the scope of the present invention.

The disclosed pole base bolt template comprises a plurality of arms removably attached to a central hub, a plurality of slotted anchor bolt holes through which may be inserted a plurality of anchor bolts, a plurality of anchor bolt diameter markings engraved in each of the plurality of slotted anchor bolt holes to ensure accurate placement of the plurality of anchor bolts in a desired bolt circle pattern, anchor bolt projection calculators to ensure proper bolt projection measurement, a plurality of bubble level holders (into which bubble levels may be "snapped" in) to ensure leveling of the pole base form as well as the bolts, and a plurality of form hooks for securing the template to the form, each form hook comprising a plurality of rebar cage alignment slots/ridges. The plurality of arms and the central hub are attached in such a way as to form an X-shaped structure that allows the pole base bolt template to provide improved quality of installation of the pole base in a simple and cost effective way.

Preferably, the template is raised from the top of the concrete form to keep the bottom leveling nuts and washers out of the concrete. This has the added advantage of providing easy access for the installer to create a smooth concrete finish on the top of the pole base at the time the concrete is poured into the form instead of attempting to remove the template and finish the top surface while the concrete is only partially set, or patching or chipping the top surface later. The template may be put together and taken apart as desired, this aspect eases attachment and increases the portability of the template, as well as allows for the attachment of arms of various lengths so that the template may be used on variously sized forms. The template provides slotted anchor bolt holes preferably marked from 7" to 14" providing accurate placement of the bolts in their desired bolt circle alignment based on the pole manufacturer's requirements. The template also comprises a large hole in the center of the template to allow for multiple conduits to be stubbed up through the concrete and centered in the pole base and within the pole itself. In addition, the rigidity and symmetry of the template slots, as well as the snap-in bubble levels, allow for a pole to be set right on the bottom leveling nuts and washers without adjustment; these features ensure the pole will always be perpendicular to the top of the base. The template also self-centers the rebar cage in the form through the use of a slot on each arm adaptable to hold a wire used to hang the cage from the template. This template provides a bolt projection calculator to ensure proper bolt projection measurement from the top of the finished pole base to the top of the anchor bolt, allowing for bolt covers to fit without cutting off the anchor bolts or creating bolt extenders for bolts placed too low in the concrete. Further, the template provides for snap-in bubble levels to ensure proper leveling of the form itself. The template also provides a pole base with high visual quality and structural integrity due to the increased accessibility while pouring concrete into the form, and while vibrating and finishing the base while the template is in place. The template is simple, accurate, inexpensive, lightweight and reusable. Finally, relative to conventional templates, this template requires no on-site material or labor to create, reduces the manpower required to set up and pour the base, reduces concrete wait time charges, reduces the number of trips between bases, and reduces the likelihood that reworking the base will be required.

It is thus a first objective of the invention to provide a cost-effective and accurate means of pole base installation.

It is a second objective of the present invention to provide improved visual and structural quality to the pole base.

It is a third objective of the invention to provide a reusable template that does not require any additional materials for support and creates a simple, standardized and repeatable method for installing pole bases.

It is a fourth objective of the invention to provide a template that is lightweight.

It is a fifth objective of the invention to provide an alternative embodiment comprising a disposable pole base bolt template for installing anchor bolts and rebar cages in a concrete pole base form employing a plurality of cardboard arms.

These and other advantages and features of the present invention are described with specificity so as to make the present invention understandable to one of ordinary skill in the art.

BRIEF DESCRIPTION OF THE DRAWINGS

In order to enhance their clarity and improve understanding of the various elements and embodiments of the invention, elements in the figures have not necessarily been drawn to scale. Furthermore, elements that are known to be common and well understood to those in the industry are not depicted in order to provide a clear view of the various embodiments of the invention. Thus the drawings are generalized in form in the interest of clarity and conciseness, wherein.

DETAILED DESCRIPTION

In the following discussion that addresses a number of embodiments and applications of the present invention, reference is made to the accompanying drawings that form a part hereof, and in which is shown by way of illustration specific embodiments in which the invention may be practiced. It is to be understood that other embodiments may be utilized and changes may be made without departing from the scope of the present invention.

Various inventive features are described below that may each be used independently of one another or in combination with other features. However, any single inventive feature may not address any of the problems discussed above or only address one of the problems discussed above. Further, one or more of the problems discussed above may not be fully addressed by any of the features described below.

It is noted that all references to anchor bolts are intended to encompass not only anchor bolts, but also all other appropriate bolts and fasteners as known in the art of installation of poles and other column-like structures.

Figure 1:
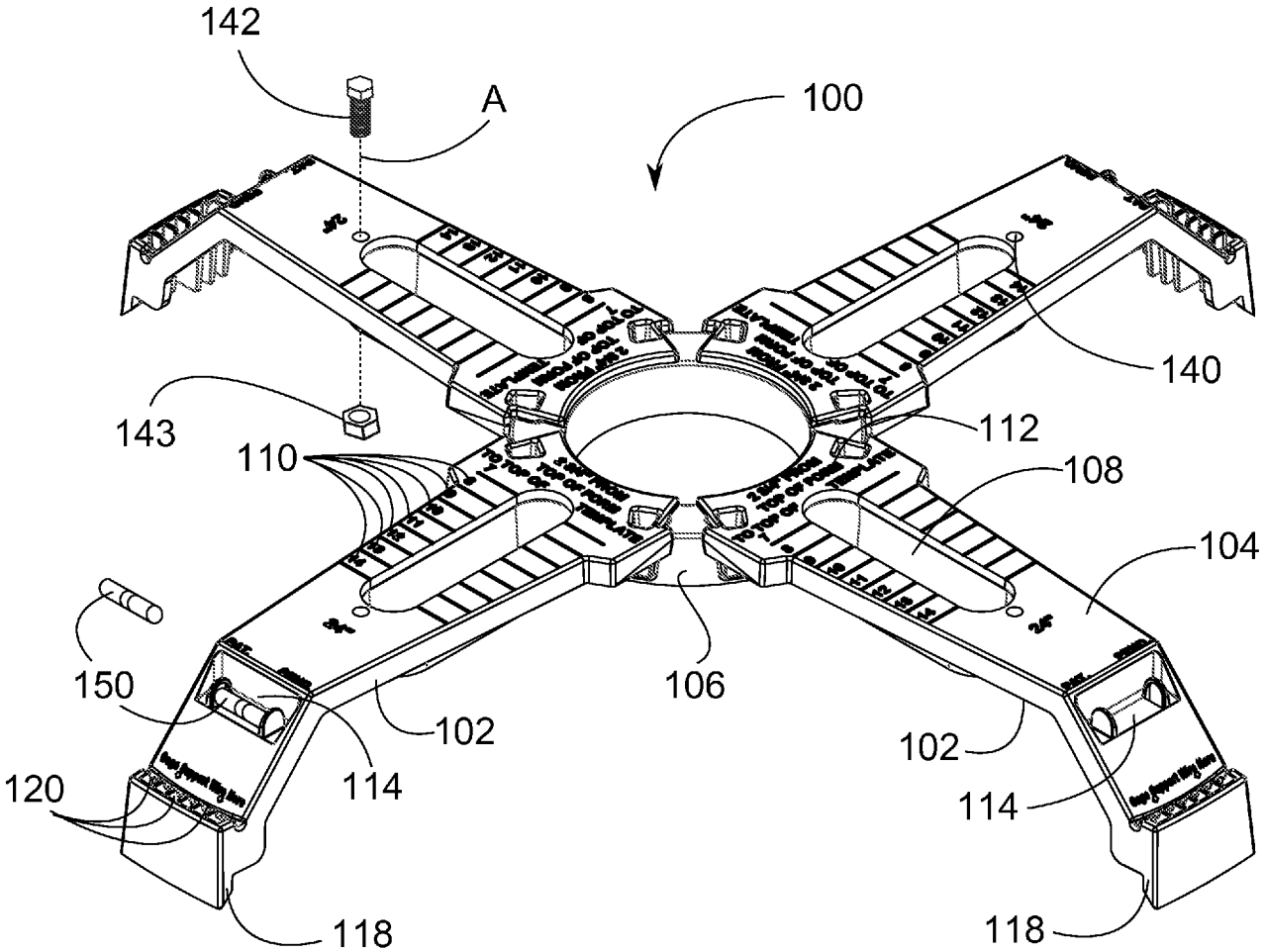
FIG. 1 illustrates a perspective view of a pole base bolt template for installing anchor bolts and rebar cages into a concrete pole base form in accordance with the preferred embodiment of the present invention.

Turning first to FIG. 1, a perspective view of a pole base bolt template 100 for installing pole anchor bolts and rebar cage in a concrete pole base form in accordance with a preferred embodiment of the present invention is illustrated. The pole base bolt template 100 comprises a plurality of arms 102 attached to a central hub 106 via both an interlocking friction fit and bolt holes 140, nut receptacles 141 (see FIG. 3), bolts 142, and nuts 143, a plurality of slotted anchor bolt holes 108 through which may be inserted a plurality of anchor bolts (not shown in this Figure), a plurality of anchor bolt diameter markings 110 engraved in each of the plurality of slotted bolt holes 108 to ensure accurate placement of the plurality of anchor bolts in a desired bolt circle pattern, a plurality of anchor bolt projection calculators 112 to ensure proper anchor bolt projection measurement, a plurality of bubble level holders 114 (into which bubble levels 150 may be "snapped") to ensure the form and template is level, and a plurality of form hooks 118 having a plurality of slots/ridges 120. The plurality of arms 102 and the central hub 106 are preferably attached in such a way as to form an X-shaped structure that allows the pole base bolt template 100 to provide improved quality and ease of installation of the concrete pole base in a simple and cost effective way.

The pole base bolt template 100 holds anchor bolts, rebar cage and conduit stubs (all not shown in FIG. 1) in a desired and preferably level location, where they will all remain for installation of a pole on the pole base once the concrete is poured and dried. Each of the plurality of arms 102 has the top surface 104 and a bottom surface 122 (See FIG. 3 for labeling). The plurality of arms 102 is preferably four in number, although greater or fewer arms may be present, and in different sizes to fit different size forms. Each of the plurality of arms 102 may be connected or disconnected from the hub 106. Preferably this connection and disconnection of the plurality of arms and the hub comprises both an interlocking friction fit between each of the plurality of arms and the hub, and also at least one bolt and nut per arm. Each of the plurality of arms 102 comprises a bolt hole 140 (FIG. 2) that corresponds to a bolt hole and nut receptacle 141 (FIG. 3) on the hub 106. In use, each of the plurality of arms 102 is interlocked with the hub 106 and then held firmly in place by a bolt 142 and nut 143 passing through both the arm and the hub, the nut residing in a nut receptacle 141 on the lower side of the hub. Note that in FIG. 1 and FIG. 4 a bolt and nut are shown in an exploded view along dashed line A. The hub 106 comprises a large central opening, thus, if the device is used on a pole base form such as that shown in FIG. 6 the template may be placed over the vertical conduits rising vertically from the center of the pole base and aligning conduits with future pole placement. Each of the plurality of slotted anchor bolt holes 108 is arranged in each of the plurality of arms 102 and is capable of incorporating various anchor bolt sizes and bolt circle sizes. Each of the plurality of anchor bolt projection calculators 112 is located proximate to each of the plurality of slotted anchor bolt holes 108 and helps to ensure the correct anchor bolt projection measurement from the finished pole base is used. The plurality of anchor bolt projection calculators 112 helps to reduce the costs to cut off long anchor bolts and of adding extension systems to short anchor bolts. Each of the plurality of bubble level holders 114 (into which bubble levels 150 may be "snapped") is positioned on each of the plurality of arms 102 and the plurality of slots/ridges 120 are adaptable to secure the rebar cage to the pole base bolt template 100. In an alternative embodiment only two bubble level holders 114 are present, located on arms 90 degrees apart from one another. The pole base bolt template 100 is constructed of lightweight plastic, preferably strong enough to support anchor bolts, rebar cage, and vibrations and force exerted by the filling material during installation. Generally speaking, the lightweight plastic template 100 repels the filling material thereby allowing for easy removal of residual filling material during and after installation. The filling material preferably comprises concrete, although other fill materials used in the pole installation industry may be used.

Figure 2:
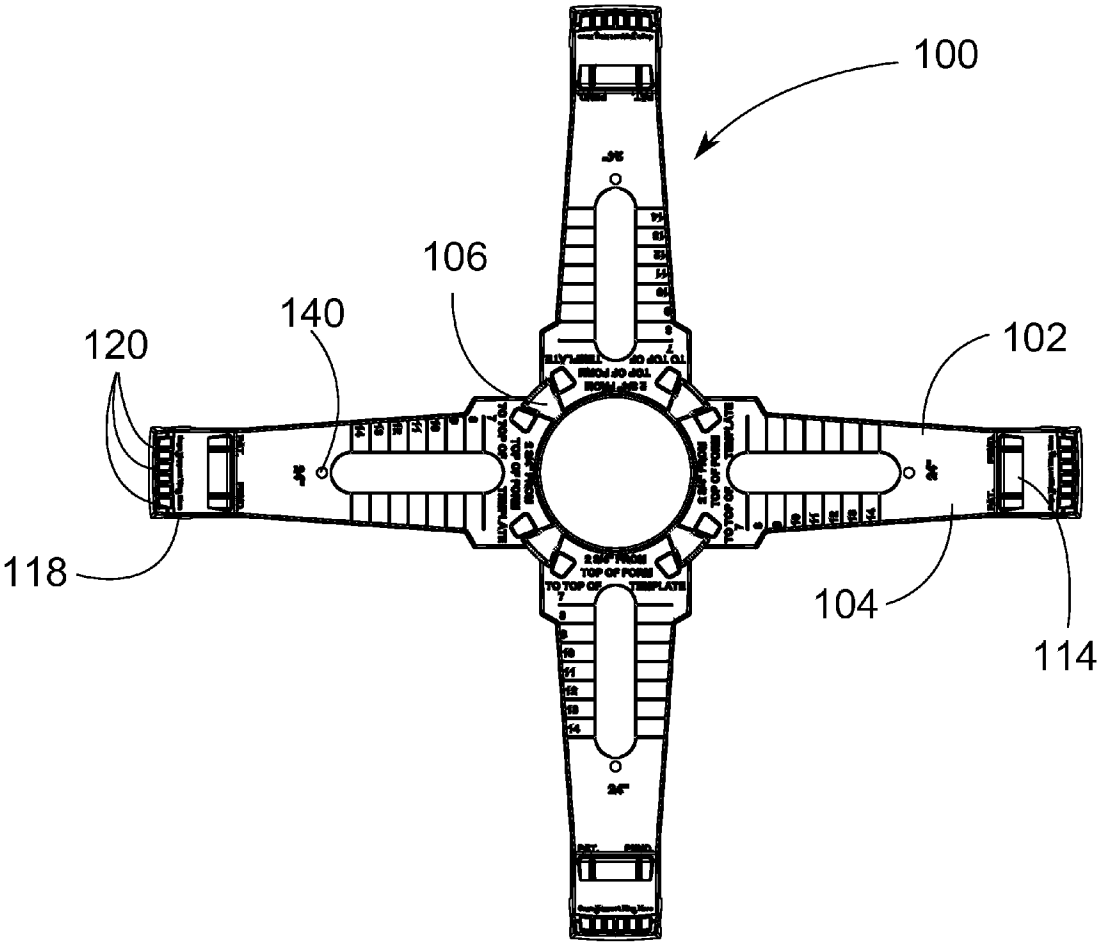
FIG. 2 illustrates a top view of the pole base bolt template for installing anchor bolts and rebar cages into a concrete pole base form in accordance with the preferred embodiment of the present invention.

Referring to FIG. 2, a top view of the pole base bolt template 100 for installing anchor bolts and rebar cages in a concrete pole base in accordance with the preferred embodiment of the present invention is illustrated. The plurality of arms 102 attach to the central hub 106 and are interlocked via a friction fit and also at least one bolt and nut per arm, in such a way to provide an X-shaped structure to the pole base bolt template 100. This arrangement allows the pole base bolt template 100 to easily fit atop a form tube, provides arms at a 90-degree angle to one another for symmetrical anchor bolt placement and increased effectiveness of the bubble levels. Furthermore, the X-shaped structure provides large gaps to ease the pouring of filling material into the form tube. The X-shape also allows for easy access to all areas of the top of the base for addition of filling material, insertion of a vibrator, and use of a smoothing tool. This compact design of the template 100 reduces required manpower, concrete wait time charges, and the likelihood of needing to rework the pole base. The plurality of arms 102 and the central hub 106 may be easily disassembled and hence provide a compact means of storage when not in use.

Figure 3:
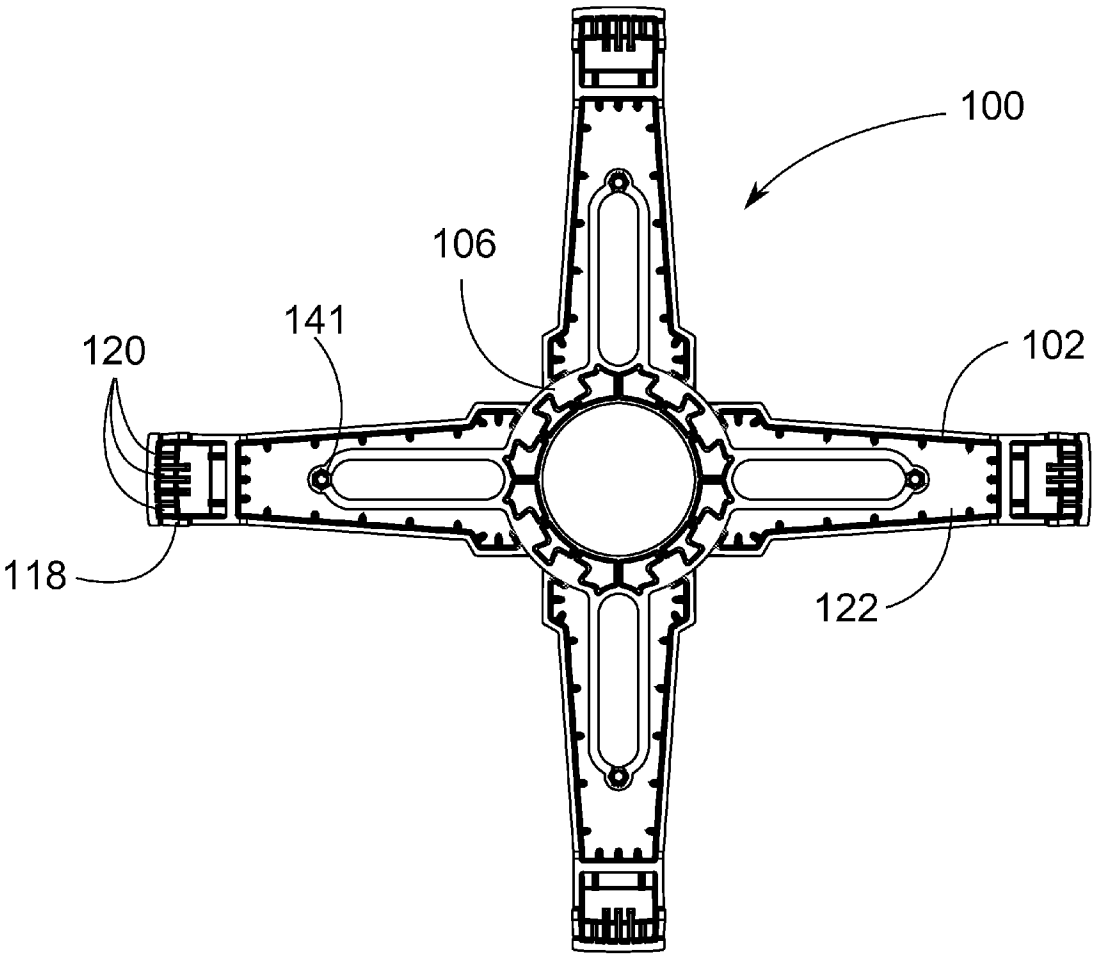
FIG. 3 illustrates a bottom view of the pole base bolt template for installing anchor bolts and rebar cages into a concrete pole base form in accordance with the preferred embodiment of the present invention.

FIG. 3 illustrates a bottom view of the pole base bolt template 100 for installing a pole on the pole base in accordance with the preferred embodiment of the present invention. The plurality of arms 102 is attached to the central hub 106 by both a friction fit interlock and by at least one bolt and nut per arm. As may be seen in FIG. 3, the hub 106 comprises a plurality of nut receptacles 141 that are used to secure the plurality of arms to the hub. The plurality of arms 102 and the central hub 106 are made of lightweight plastic. Each of the plurality of arms 102 includes a top surface 104 and a bottom surface 122. The plurality of rebar cage alignment slots/ridges 120 on the plurality of form hooks 118 helps to secure the template 100 to the form tube and to maintain position during pouring of concrete, even when the template is bumped and would have otherwise been dislodged. The template 100 works independently and hence does not require any additional materials for use in setting anchor bolts and a rebar cage in a pole base form. Thus, the template 100 results in improved quality of installation with low cost, reduced time, less material cost, less reworking, and less overall labor.

Figure 4:
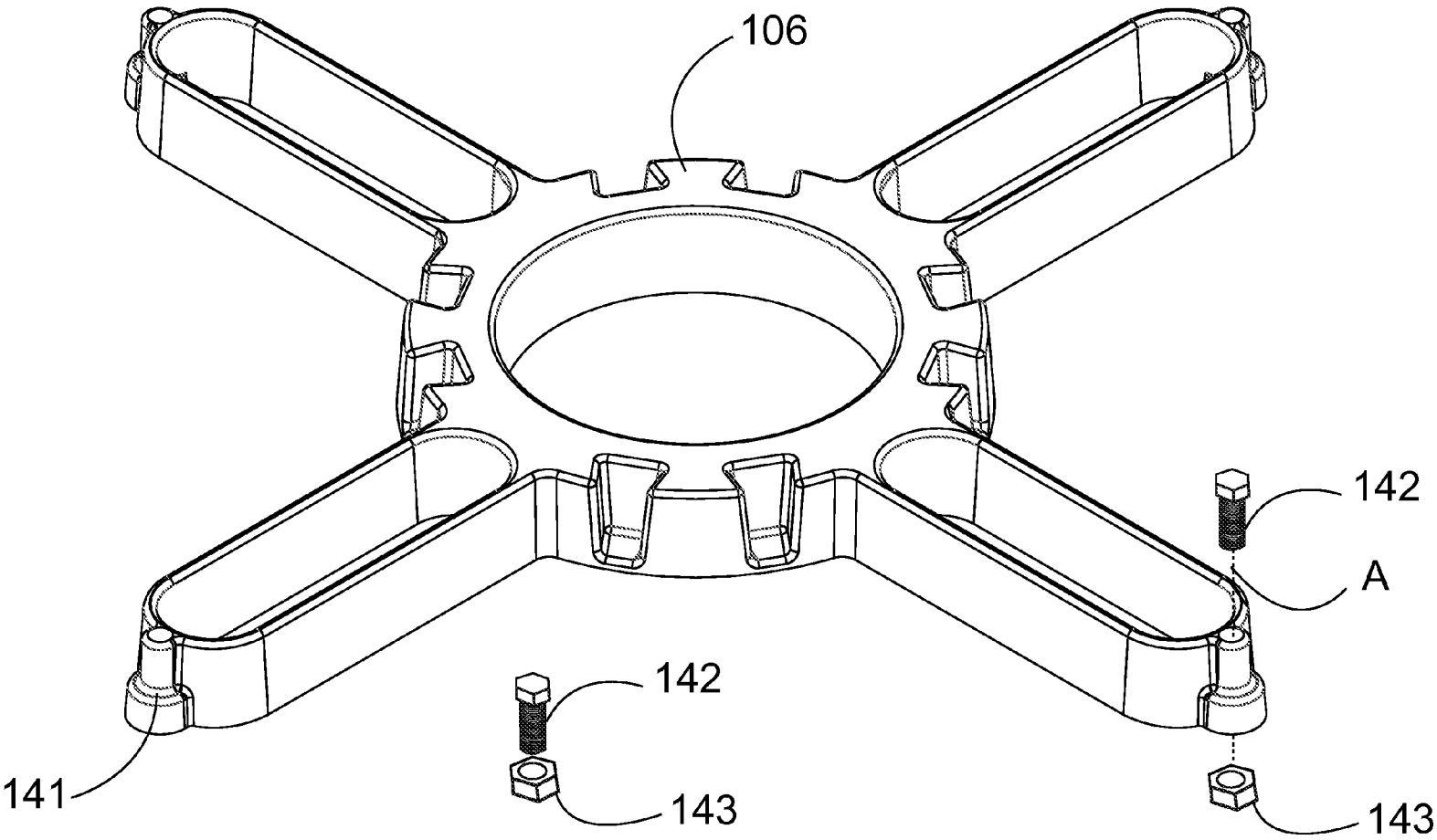
FIG. 4 illustrates a perspective view of the hub of the pole base bolt template for installing anchor bolts and rebar cages into a concrete pole base form in accordance with the preferred embodiment of the present invention.

FIG. 4 illustrates a perspective view of the hub of the pole base bolt template for installing anchor bolts and rebar cages into a concrete pole base form in accordance with the preferred embodiment of the present invention. The bolt holes and nut receptacles 141 may be seen more clearly in this view. As is illustrated by exploded view line A, when assembled, each bolt hole and nut receptacle has a corresponding bolt 142 and nut 143 inserted therein.

Figure 5:
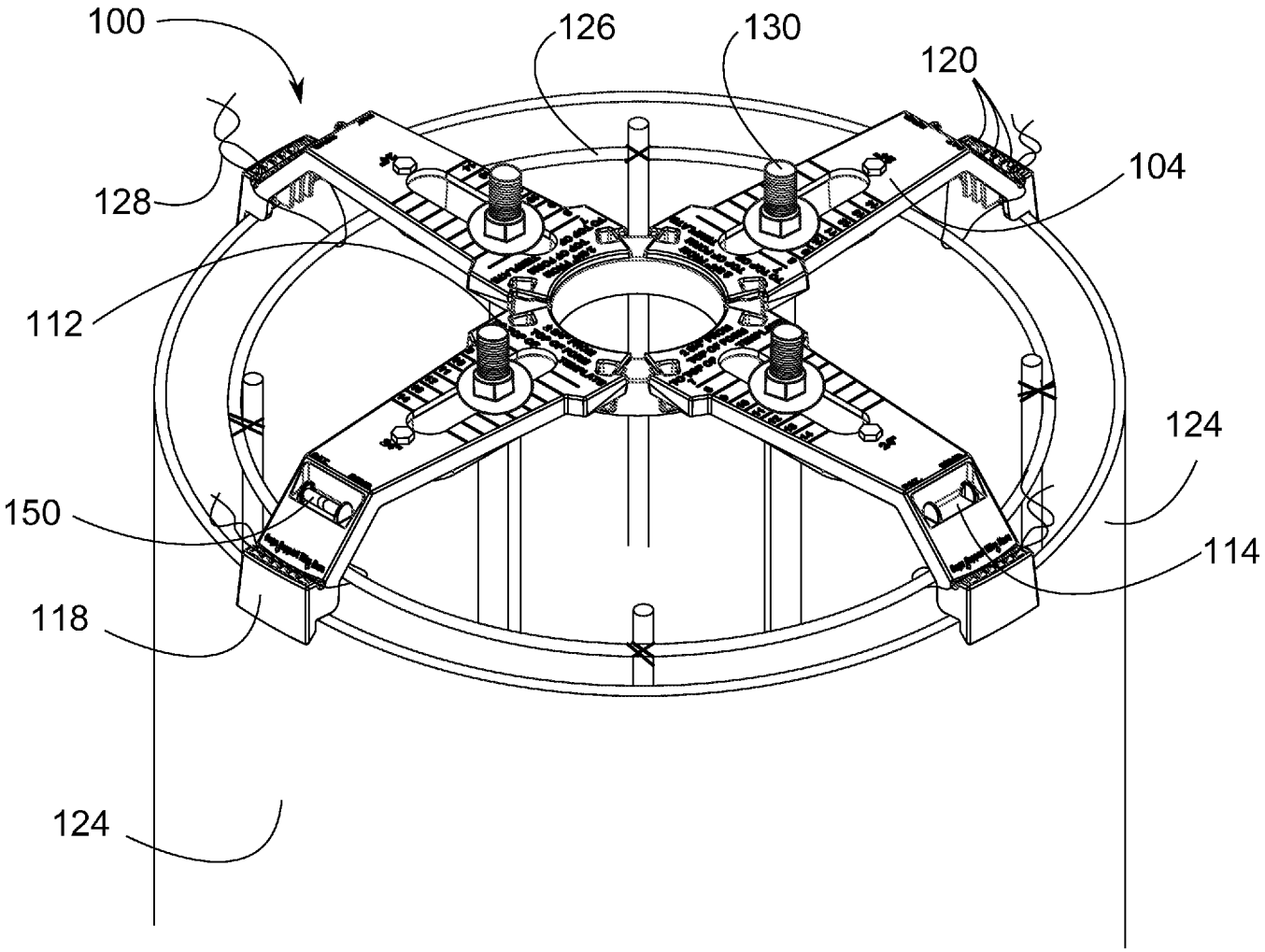
FIG. 5 illustrates the pole base bolt template placed on top of a form tube with anchor bolts installed in the bolt slots as well as a rebar cage hanging from the template in accordance with the preferred embodiment of the present invention.

FIG. 5 illustrates the pole base bolt template 100 attached to a form tube 124 in accordance with the preferred embodiment of the present invention. The template 100 is attached to the form tube 124 by means of the plurality of form hooks 118 and by the combined weight of the cage, anchor bolts and template. Each of the plurality of form hooks 118 is adaptable to secure the pole base bolt template 100 to the form tube 124. The form tube 124 may be made of cardboard, plastic, metal or other materials. The plurality of rebar cage alignment slots/ridges 120 allows the template 100 to maintain position during pouring of concrete. The plurality of rebar cage alignment slots/ridges 120 also secures the rebar cage 126 to the template 100 by means of wires 128. The plurality of rebar cage alignment slots/ridges 120, which are at the same location on each arm, helps to easily center the rebar cage 126 and to maintain its position while pouring the filling material into the form tube 124. This helps ensure structural rigidity of the pole base. Additionally, the weight of the rebar cage, now supported via wire 128 by the pole base bolt template, helps secure the base bolt template 100 to the form tube 124, and ensures that the base bolt template 100 does not move during or subsequent to the filling of the form tube 124. The plurality of bubble level holders 114 (and their associated "snapped-in" bubble levels 150) ensures that the pole base form and anchor bolts are maintaining their level position before, during and after the pouring of concrete into the form tube 124. The plurality of bubble level holders 114 (and their associated "snapped-in" bubble levels 150) also ensures that final settings of the plurality of anchor bolts 130 are vertical and bottom nuts 129 (FIG. 7A) are level. As will be shown later, because the bottom nuts 129 and related bottom washers 132 are level, the base plate 135 of the pole and hence the pole will consequently be level. See FIG. 7B. Furthermore, although in its preferred embodiment the By utilizing these features, the pole base bolt template 100 ensures structural integrity of the pole base, eases installation, and improves visual quality of the final pole base.

The plurality of anchor bolt projection calculators 112 ensure proper anchor bolt projection measurement distance from the top of the finished base to the top of the anchor bolts. The plurality of anchor bolt projection calculators 112 reveals the distance from the top of the form tube 124 to the top surface 104 of the template 100. For example, if a 6-inch anchor bolt projection is required, the measurement is 2¾ inches from the top of the form tube 124 (as written on the template 100) to the top surface 104 of the template 100, plus another 3¼ inches, as determined by subtracting 2¾ inches from 6 inches. Therefore the anchor bolts must protrude 3¼ inches higher than the top surface 104.

Figure 6:
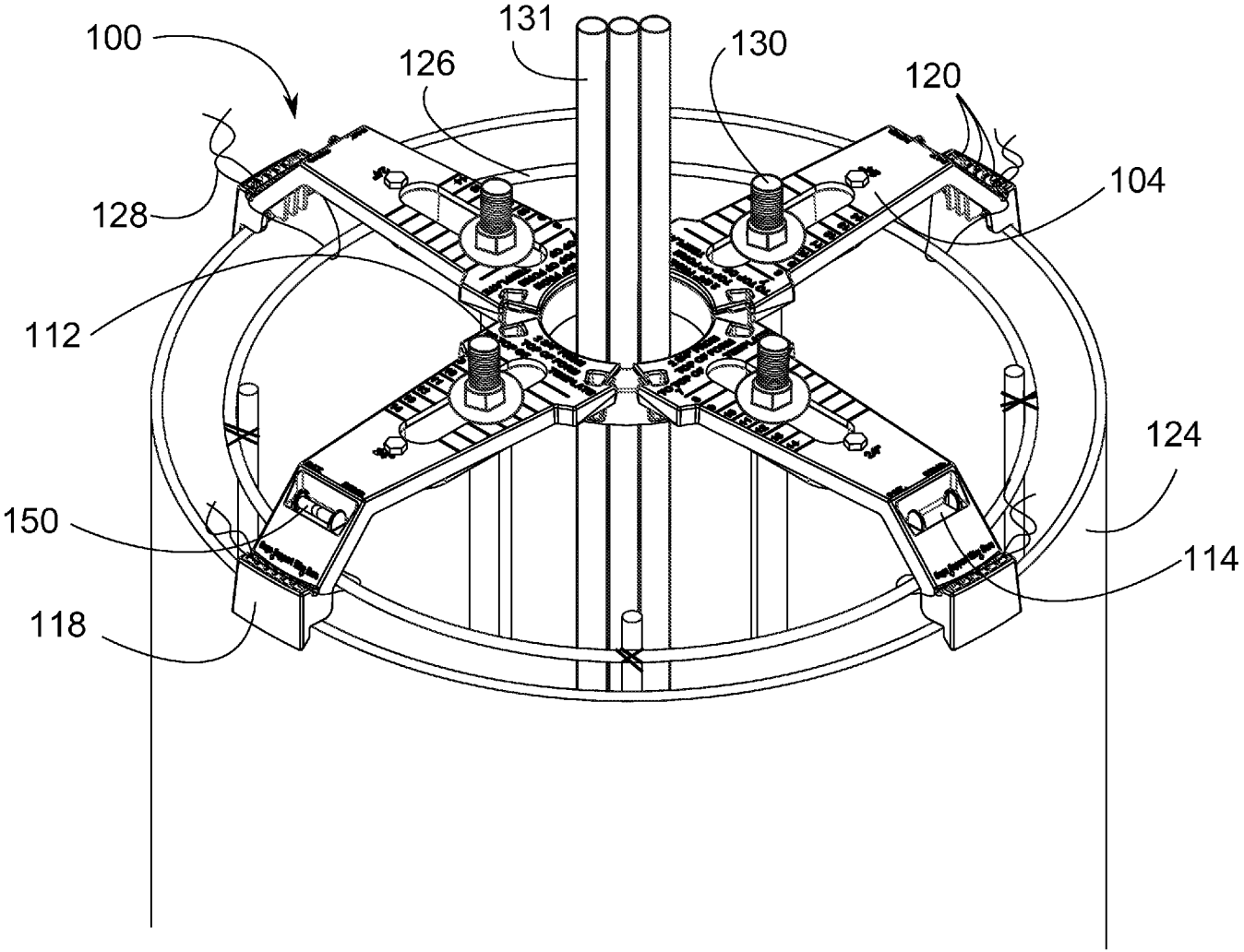
FIG. 6 illustrates the pole base bolt template with conduits penetrating the center hole of the template for future placement of wires to the pole in accordance with the preferred embodiment of the present invention.

FIG. 6 illustrates installation of the pole base template 100 with the conduit stubs 131 inserted through the center hub 106 in accordance with the preferred embodiment of the present invention. The conduit stub installation is initiated by placing the pole base bolt template 100 over the form tube 124 and around the conduits 131. Conduit stubs are often, but not always, present, and generally serve as conduits for electrical wiring for the pole eventually installed. The template 100 is secured to the form tube 124 by the plurality of hooks 118. The rebar cage 126 is then secured to the pole base bolt template 100 with the help of the plurality of slots/ridges 120 by means of wires 128. Although in this preferred embodiment a rebar cage is secured to the pole base bolt template 100, in an alternative embodiment the rebar cage is omitted and the form tube 124 is simply filled with filling material as described below.

Following the steps described above, the form tube 124 is filled with filling material. The template 100 maintains its position during the pouring of the filling material. The plurality of bubble level holders 114 (and their associated "snapped-in" bubble levels 150) may be used by the installers to ensure a level pour of the filling material, and more importantly to ensure leveling of the template 100 itself. The plurality of slots/ridges 120 help to align the rebar cage 126 in the center of the form tube, and also maintain the position of the rebar cage 126 during installation, as well as ensuring that the base bolt template 100 does not move by virtue of the weight of the suspended rebar cage 126 holding the plurality of hooks 118 against the form tube 124. The plurality of anchor bolt projection calculators 112 helps to ensure proper anchor bolt projection measurement from top of the form tube 124 to the top surface 104 of the template 100 thereby enabling accurate anchor bolt height. The plurality of bolt diameter markings 110 (Labeled in FIG. 1) helps to ensure accurate diameter placement of the anchor bolts 130 and also ensures that no changes have been made to the diameter during installation. The plurality of anchor bolt diameter markings 110 in this exemplary case includes markings from 7 to 14 inches, although other distances may be provided.

The template 100 is raised in design thereby allowing easy finishing of the entire top surface of the filling material without removing the template 100. Since the template 100 is raised in shape, the template 100 does not leave a mark on top of the finished pole base. The arched design allows the template 100 to remain in position until the filling material cures, and hence the plurality of anchor bolts 130 will not be moved in wet filling material and the rebar cage will maintain its position. Moreover, this raised and compact design of the template 100 reduces the amount of the filling material that adheres to the template 100 during installation. The template 100 also helps to maintain the cylindrical shape of the form tube 124, which results in increased quality of installation and finished product. At this time the form tube 124 may be removed from the concrete base exposing a smooth finished concrete pole base.

Figure 7A:
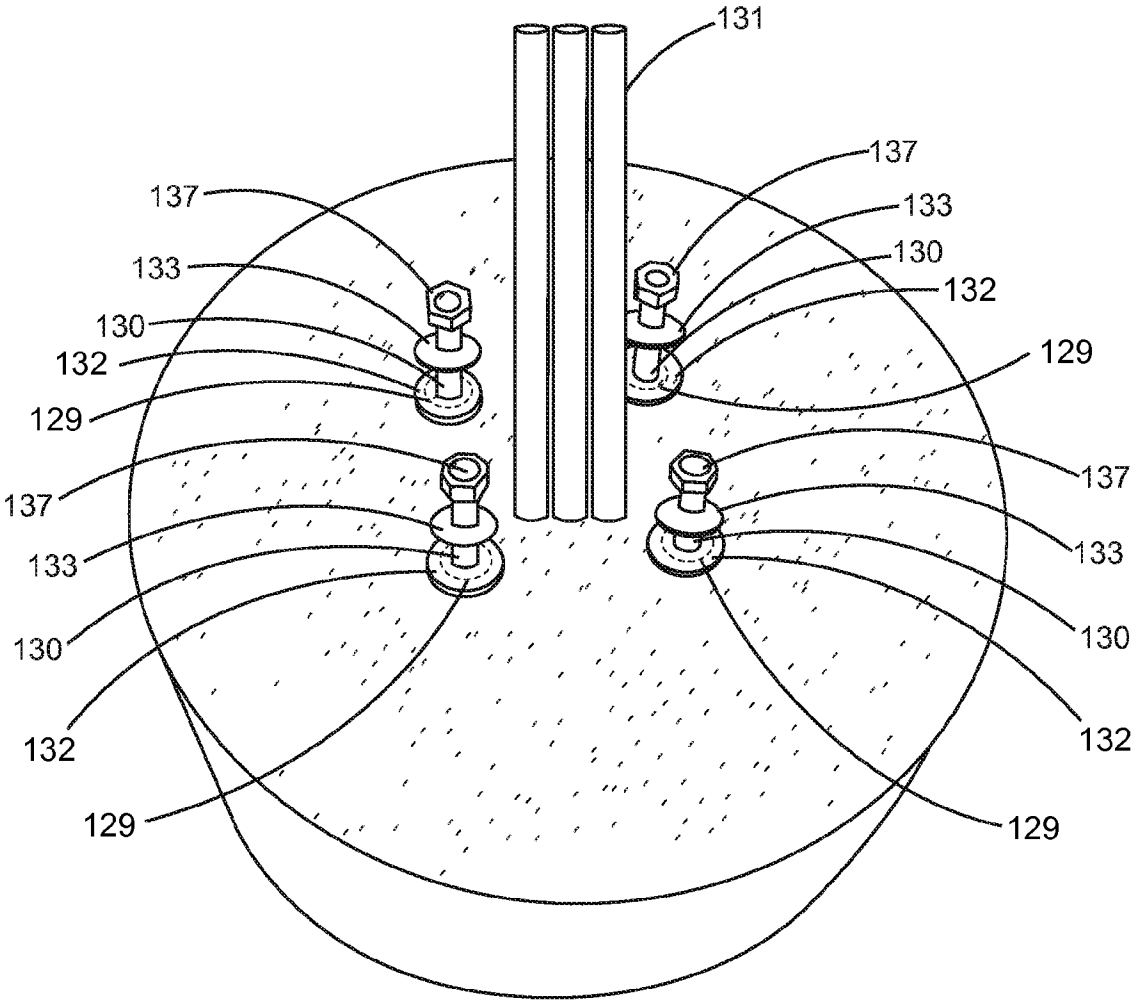
FIG. 7A illustrates a pole base form filled with concrete that has been smoothed and allowed to set up, then the template was removed in accordance with the preferred embodiment of the present invention, and wherein conduits, (4) anchor bolts, (8) washers and (8) nuts are protruding from the base and clear of the top of the concrete.

FIG. 7A shows the base after the filling material has set up and the template and form tube have been removed. Here, several components are shown, and some are shown with phantom lines due to their being hidden. First, it is noted that anchor bolts 130 are still present after the template 100 (not shown in the remainder of the figures) is removed. Furthermore, the bottom nut 129 and bottom washer 132 remain, and are level. Bottom nut 129 and bottom washer 132 are all level with one another because each bottom nut 129 was flush with the bottom of template 100, which was level prior to removal. It is noted that bottom nut 129 is only shown in phantom lines, due to it being underneath bottom washer 132. Preferably, bottom nut 129 is slightly elevated from the top of the filling material, provided that the filling material did not exceed the top of the form tube.

Figure 7B:
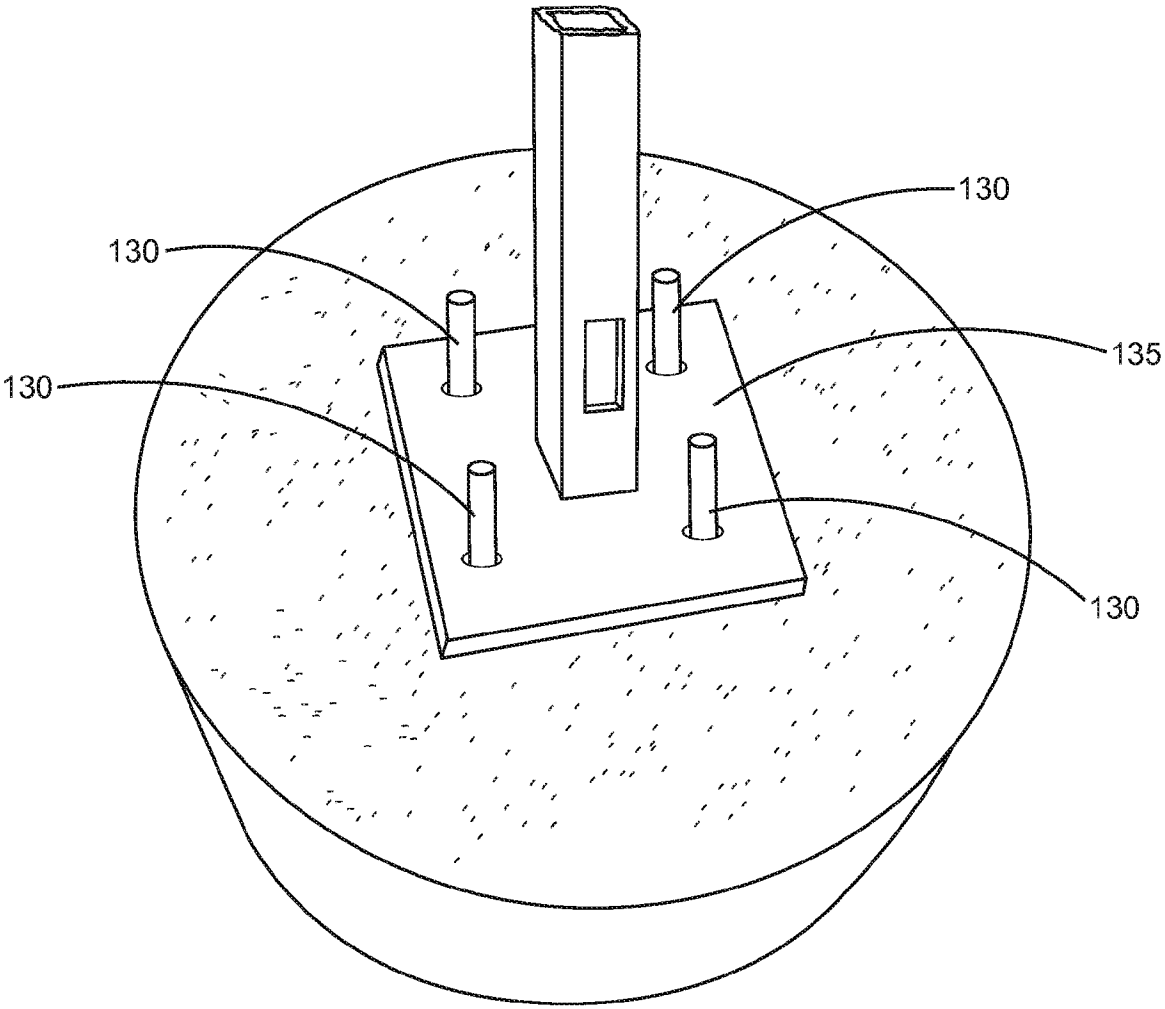
FIG. 7B illustrates a concrete pole base stripped of its form in accordance with the preferred embodiment of the present invention, and wherein a pole is placed on top of the (4) anchor bolts, (4) bottom leveling nuts and (4) washers in an unsecured fashion.
Figure 7C:
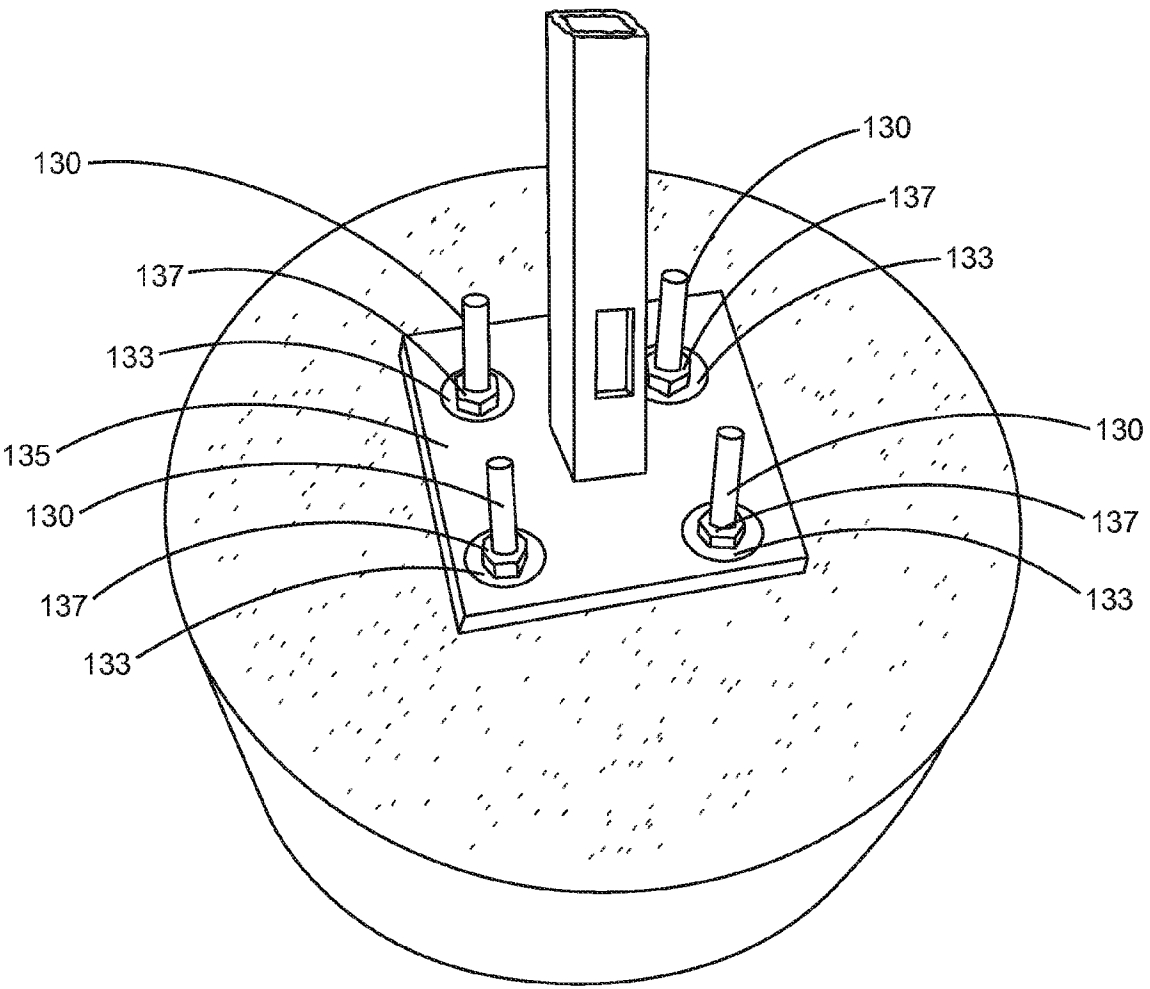
FIG. 7C illustrates a concrete pole base wherein a pole is placed on top of the pole base (4) anchor bolts, (4) bottom nuts and (4) washers and fully secured with the top (4) washers and (4) nuts in accordance with the preferred embodiment of the present invention.

Also attached to anchor bolts 130, and for purposes of illustration here, are top nut 137 and top washer 133. In use, these not need be attached at this stage. Their function will become more apparent in FIG. 7C. In FIG. 7B the pole and attached pole base plate 135, and its aligned precut bolt circle holes, are placed over the vertically rising anchor bolts 130 and conduit stubs 131. The pole base is resting on bottom washers 132 and bottom nuts 129, now hidden from view. FIG. 7C illustrates the finished pole base, pole and corresponding pole base plate 135 with top washer 133 and top nut 137 securely holding the pole base plate 135 and pole in place in accordance with the preferred embodiment of the present invention.

Figure 8:
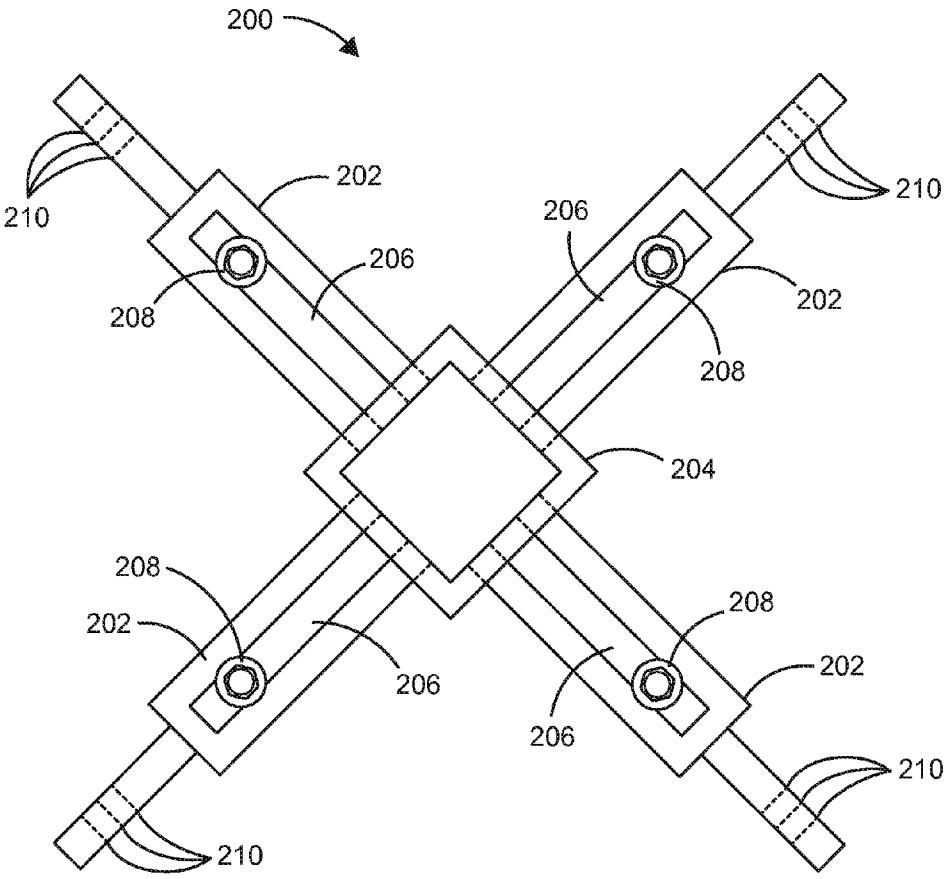
FIG. 8 illustrates a pole base bolt template for installing anchor bolts and rebar cage in a pole base form in accordance with an alternative embodiment of the present invention.

FIG. 8 illustrates a pole base bolt template 200 for installing a pole on a pole base in accordance with an alternative embodiment of the present invention. In this embodiment, the template 200 comprises a plurality of arms 202 interlocked by means of a central hub 204, a plurality of slotted bolt holes 206 to insert a plurality of anchor bolts 208 and a rebar support notch 218 (see FIG. 9). The plurality of arms 202 and the central hub 204 are interlocked in such a way as to form an X-shaped structure that allows the pole base bolt template 200 to provide improved quality of installation of the pole base in a simple and cost effective way. The plurality of arms 202 includes preferably four arms placed at 90, 180, 270 and 360 degrees respectively around the central hub 204, although other numbers of arms may be used and other degrees of separation between them. The plurality of arms 202 may be made of a material selected from a group consisting of: cardboard and corrugated paper. The central hub 204 is preferably made of plastic material, or if made of cardboard or paper is made from such materials having structural qualities capable of supporting the previous mentioned components during installation. Each of the plurality of arms 202 includes a plurality of perforations 210, which represent weaker spots in the material, and at which the distal portion of the arm (beyond the perforation) may be torn off and removed from the portion of the arm proximate the hub. The portion of the arm removed is disposable. This compact design of the template 200 helps to reduce the manpower required, concrete wait time charges, and reworking requirements, and almost all of the same features provided by the template 100.

Figure 9:
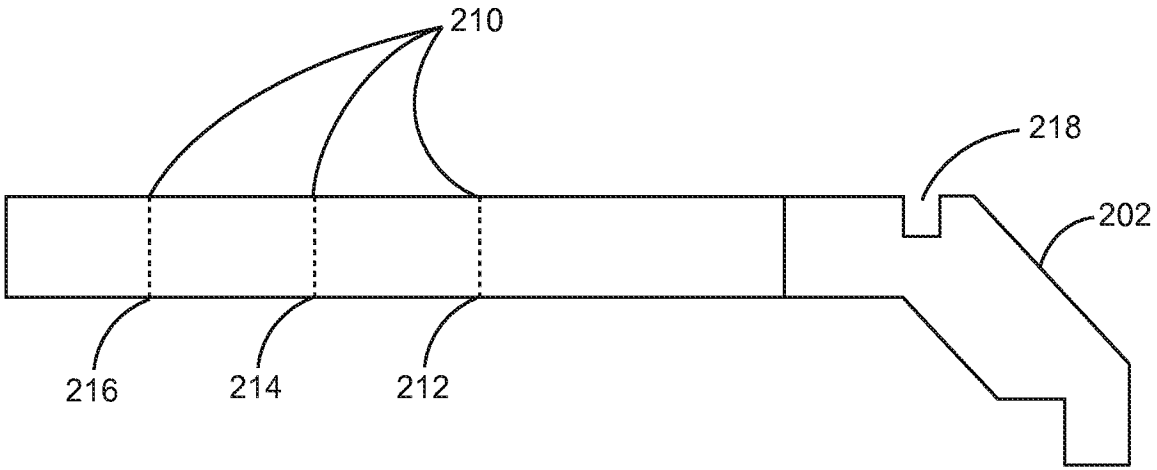
FIG. 9 illustrates a side view of at least one of the plurality of arms of the pole base bolt template shown in FIG. 8 and in accordance with the alternative embodiment of the present invention.

FIG. 9 illustrates a side view of one of the plurality of arms 202 of the pole base bolt template 200 shown in FIG. 8. Each of the plurality of arms 202 includes the plurality of perforations 210. The plurality of perforations 210 is variable but in this exemplary embodiment is three, and may further be divided as first perforation 212, second perforation 214 and third perforation 216. The plurality of perforations 210 allows the user to tear off the distal portion of the at least one of the plurality of arms 202 so as to fit with various pole base forms. For instance, if the first perforation 212, the second perforation 214 and the third perforation 216 are marked at 7.5 inches, 10.5 inches and 13.5 inches respectively, then if the user tears off the perforations at the first perforation 212 marked at 7.5 inches, it would result in the template 200 with a plurality of arms 202, each being 7.5 inches in length. The total diameter of the template 200 would thus be 18 inches, as formed by two of the plurality of arms of 7.5 inches length and the central hub of 3 inches (7.5"×2 arms+the 3" central hub=18 inches). Likewise, if the user desires to use the template 200 for a different width, such as 30 inches, then the user could tear the arms off at the third perforation 216 marked at 13.5 inches, as then the two arms of 13.5 inches and the central hub of 3 inches would sum to a total diameter of 30 inches (13.5"×2 arms+the 3" central hub=30 inches). Otherwise, if the user does not tear the arms off at any of the perforations, then, the length of the arm 202 remains 16.5 inches. Two of these arms and the central hub would allow the template to be used for a 36-inch pole base (13.5"×2 arms+the 3 inch central hub=36 inches).

The embodiments discussed above, when used with anchor bolts, will provide pole base installers a competitive advantage for their services compared to those not utilizing the pole base bolt template. The pole base bolt template adds competitive advantages for the pole base installer by reducing the cost of construction for pole bases and pole installation, increasing visual quality and structural integrity of the finished product, reusability, eliminating waste, and providing greater ease of use and higher rate of success in installation of poles. By reducing the cost and time required for construction, and by requiring less initial labor and less material costs, pole base installers using the disclosed base bolt template will have an overall lower cost of installation.

Through the significant cost savings, increases in quality of installation, and ease of use by contractors, pole base installers incorporating the base bolt template will become the contractor of choice. Owners, architects, designers, engineers and contractors will see the added value and promote contractors using the base bolt template.

The foregoing description of the preferred embodiment of the present invention has been presented for the purpose of illustration and description. It is not intended to be exhaustive or to limit the invention to the precise form disclosed. Many modifications and variations are possible in light of the above teachings. For example, the pole base bolt template 200 may include a plurality of bolt diameter markings to ensure accurate placement of the plurality of anchor bolts in a desired bolt circle pattern, a plurality of bolt projection calculators to ensure proper bolt projection measurement, a plurality of bubble levels to ensure level of filling material and a plurality of hooks to secure the base bolt template to a form tube. Further, the base bolt template (100, 200) may be used to support various bolt sizes and bolt circle dimensions. In addition, the measurement provided by the plurality of bolt projection calculators 112 may vary for templates of various sizes.

We claim:

1. A pole base bolt template for the easy and accurate placement of anchor bolts in concrete forms, the pole base bolt template comprising:

a. a plurality of arms removably attached to a central hub via a friction fit, wherein both the plurality of arms and the central hub have bottom surfaces and wherein gaps are present between each of the plurality of arms;

b. wherein each arm comprises:

i. a slotted bolt hole adaptable to engage an anchor bolt, to which an upper nut and lower nut is threaded;

ii. at least one bolt diameter marking;

iii. a form hook configured to secure and center the pole base bolt template to a form tube having a top surface; and c. wherein each arm positions each said lower nut above said top surface of the form tube; and d. wherein at least 90% of a lowermost portion of both the bottom surface of the plurality of arms and bottom surface of the central hub is at least 1 inch above the top surface of the form tube.

2. The pole base bolt template of claim 1 wherein:

a. at least one arm comprises a bubble level holder adaptable to hold a bubble level.

3. The pole base bolt template of claim 2 wherein:

a. at least two arms comprise a bubble level holder adaptable to hold a bubble level and at least two bubble levels are held by at least two arms.

4. The pole base bolt template of claim 3 wherein:

a. the angle between the plurality of arms is (360 degrees) divided by (number of arms).

5. The pole base bolt template of claim 1 wherein:

a. the arm bottom surface is at least 1 inch above the top surface of the form tube.

6. The pole base bolt template of claim 1 further comprising:

a. a large central hole.

7. The pole base bolt template of claim 1 further comprising:

a. at least one bolt projection calculator.

8. The pole base bolt template of claim 1 comprising:

a. four arms equally distributed around the central hub.

9. A pole base bolt template for the easy and accurate placement of anchor bolts in concrete forms, the pole base bolt template comprising:

a. a plurality of arms arranged around a central hub and removably attached to said central hub via a friction fit, wherein both the plurality of arms and the central hub have bottom surfaces and wherein gaps are present between each of the plurality of arms;

b. wherein each arm comprises a slotted bolt hole, and is configured to secure the pole base bolt template to a form tube having a top surface; and c. wherein at least 90% of a lowermost portion of the bottom surface of the arms and the central hub is positioned above said top surface of the form tube.

10. The pole base bolt template of claim 9 wherein:

a. each slotted bolt hole is adaptable to secure an anchor bolt to the pole base bolt template.

11. The pole base bolt template of claim 9 wherein:

a. at least two arms comprise a bubble level holder adaptable to hold a bubble level.

12. The pole base bolt template of claim 11 wherein:

a. the at least two arms are attached to the central hub 90 degrees offset from each other.

13. The pole base bolt template of claim 11 wherein:

a. the angle between the plurality of arms is (360 degrees) divided by (number of arms).

14. The pole base bolt template of claim 9 wherein:

a. the arm bottom surface is at least 1 inch above the top surface of the form tube.

15. The pole base bolt template of claim 9 further comprising:

a. a large central hole.

16. The pole base bolt template of claim 9 further comprising:

a. at least one bolt projection calculator.

* * * * *